United States Patent [19]

Yokoyama

[11] Patent Number: 4,919,110

[45] Date of Patent: Apr. 24, 1990

[54] GAS COOKING APPLIANCE

[75] Inventor: Nobuyoshi Yokoyama, Nagoya, Japan

[73] Assignee: Paloma Kogyo Kabushiki Kaisha, Nagoya, Japan

[21] Appl. No.: 223,366

[22] Filed: Jul. 25, 1988

[30] Foreign Application Priority Data

Jul. 25, 1987 [JP] Japan ..... 62-114402[U]

[51] Int. Cl.[5] ..... F24C 3/00

[52] U.S. Cl. ..... 126/394; 126/39 R; 126/39 E; 431/1; 99/422; 99/447

[58] Field of Search ..... 126/39 D, 39 E, 39 F, 126/39 H, 39 J, 39 K, 39 N, 214 A, 214 D, 214 R; 431/1; 99/422, 447; 165/168, 170

[56] References Cited

U.S. PATENT DOCUMENTS

| | | | |
|---|---|---|---|
| 2,870,828 | 1/1959 | Hess | 126/39 J |
| 2,870,829 | 1/1959 | Williams | 126/39 H |
| 3,525,325 | 8/1970 | Perl | 126/39 J |
| 4,286,583 | 9/1981 | Dunn et al. | 165/170 |
| 4,384,513 | 5/1983 | Pierick | 99/447 |
| 4,475,621 | 10/1984 | Cherington et al. | 431/1 |
| 4,570,610 | 2/1988 | Himmel | 126/39 H |

FOREIGN PATENT DOCUMENTS

| | | | |
|---|---|---|---|
| 59-21552 | 12/1984 | Japan | 126/39 H |
| 192076 | 2/1924 | United Kingdom | 126/214 R |

*Primary Examiner*—James C. Yeung

*Attorney, Agent, or Firm*—Berman, Aisenberg & Platt

[57] ABSTRACT

A gas cooking appliance for cooking chow mein, pan cakes or the like on a hot plate mounted thereon, which cooking appliance includes a pulse combustion burner installed within an internal compartment of the appliance and having a combustion chamber coupled with a bottom portion of the hot plate to take place pulse combustion of a mixture of gaseous fuel and air supplied thereinto, wherein the hot plate is in the form of a thick metallic plate formed therein with a tailpipe passage which is connected at one end thereof to an exhaust port of the combustion chamber and extends outwardly through the metallic plate to permit the flow of combustion products discharged therethrough from said combustion chamber.

7 Claims, 3 Drawing Sheets

GAS COOKING APPLIANCE

BACKGROUND OF THE INVENTION

The present invention relates to a gas cooking appliance used for cooking chow mein, pan cakes or the like on a hot plate mounted thereon, and more particularly to a gas cooking appliance in which a pulse combustion burner is adapted to heat the hot plate.

During use of a gas cooking appliance of this kind in which a conventional gas burner is adapted to heat the hot plate, only a small portion of exhaust gas of the burner is useful to heat the hot plate but a large portion of the exhaust gas is wasted. For this reason, the heat of the exhaust gas may not be sufficiently utilized.

SUMMARY OF THE INVENTION

It is, therefore, a primary object of the present invention to provide a gas cooking appliance equipped with a pulse combustion burner so arranged as to efficiently utilize the heat of combustion products of the burner before being discharged.

According to the present invention, the primary object is attained by providing a gas cooking appliance for cooking chow mein, pan cakes or the like on a hot plate mounted thereon, which cooking appliance comprises a pulse combustion burner installed within an internal compartment of the appliance and having a combustion chamber coupled with a bottom portion of the hot plate to effect pulse combustion of a mixture of gaseous fuel and air supplied thereinto, wherein the hot plate is in the form of a thick metallic plate formed therein with a tailpipe passage which is connected at its one end to an exhaust port of the combustion chamber and extends outwardly through the metallic plate to permit the flow of combustion products discharged therethrough from the combustion chamber.

In a practical embodiment of the present invention, the combustion chamber of the burner is coupled with a center of the bottom portion of the metallic plate, and the metallic plate is formed therein with a pair of sinuous tailpipe passages which are connected at their one ends to the exhaust port of the combustion chamber and extend outwardly through a half part of the metallic plate respectively to permit the flow of combustion products discharged therethrough from the combustion chamber. In the embodiment, it is preferable that an annular exhaust decoupler is arranged in surrounding relationship with the combustion chamber and connected to the other ends of the tailpipe passages.

BRIEF DESCRIPTION OF THE DRAWINGS

Other objects, features and advantages of the present invention will be more readily appreciated from the following detailed description of preferred embodiments thereof when considered with reference to the accompanying drawings, in which.

DESCRIPTION OF THE PREFERRED EMBODIMENTS

Figure 1:
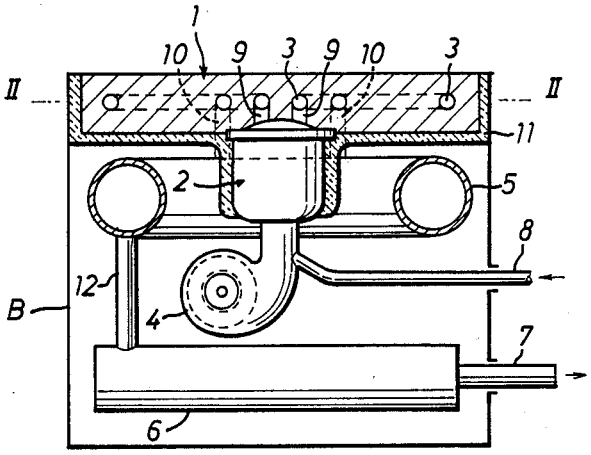
FIG. 1 is a vertical sectional view of a gas cooking appliance in accordance with the present invention.
Figure 2:
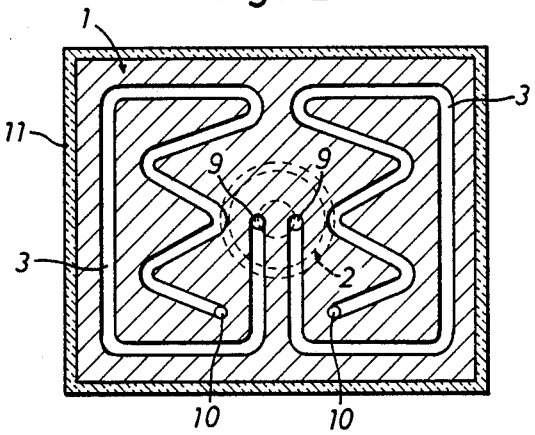
FIG. 2 is a cross-sectional view taken along line II—II in FIG. 1.

The gas cooking appliance illustrated in FIGS. 1 and 2 comprises a hot plate in the form of a thick iron plate 1 horizontally mounted on a box-type cabinet B, and a pulse combustion burner 2 assembled with a bottom portion of iron plate 1 and arranged within an internal compartment of cabinet B. The pulse combustion burner 2 has a combustion chamber unitedly coupled with a center of the bottom portion of iron plate 1 and arranged to be forcibly supplied with fresh combustion air from an electrically operated blower 4 and supplied with gaseous fuel from a gas supply conduit 8. The iron plate 1 and the combustion chamber of burner 2 are covered with a heat insulating layer 11 to prevent heat transfer to the internal compartment of cabinet B. The iron plate 1 is formed therein with a pair of tailpipe passages 3 which are connected at 9 to an exhaust port of the combustion chamber and extend respectively through a half part of iron plate 1 outwardly to permit the flow of combustion products discharged therethrough from the combustion chamber of burner 2.

Figure 3:
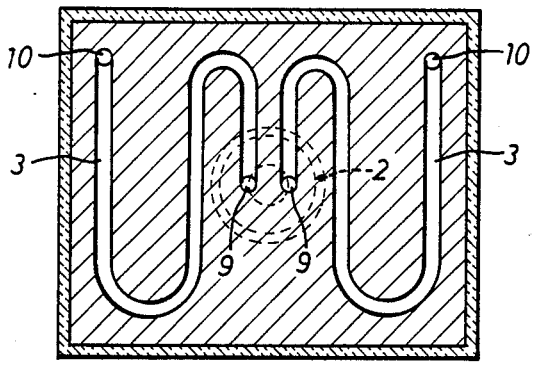
FIG. 3 illustrates a modification of an arrangement of tailpipe passages shown in FIGS. 1 and 2.
Figure 4:
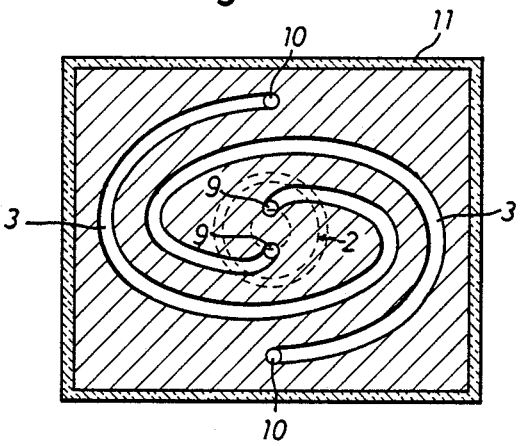
FIG. 4 illustrates another modification of the arrangement of tailpipe passages.

The cooking appliance further comprises an annular exhaust decoupler 5 arranged in surrounding relationship with the combustion chamber of burner 2 and connected at 10 to the outlets of tailpipe passages 3 in iron plate 1, and a muffler 6 arranged under the combustion chamber of burner 2 and connected at its one end to the exhaust decoupler 5 by means of a connecting pipe 12 and at its other end to an exhaust pipe 7. In the cooking appliance, as shown in FIG. 2, the tailpipe passages are arranged symmetrically with respect to the combustion chamber of burner 2. In an attempt to effect uniform heat transfer to the entirety of iron plate 1, the tailpipe passages 3 each are formed to have an inside waved section encircled by an outside curved section extending from the exhaust port of the combustion chamber. The arrangement of tailpipe passages 3 may be modified as shown in FIG. 3, wherein a pair of sinuous tailpipe passages 3 each are formed in the iron plate 1 to have an inside curved section extending from the exhaust port of the combustion chamber and an outside curved section extending outwardly from the inside curved section and connected at its outlet to the exhaust decoupler 5. The arrangement of tailpipe passages 3 may be further modified as shown in FIG. 4, wherein a pair of spiral tailpipe passages 3 are formed in the iron plate 1 to extend in parallel outwardly from the exhaust port of the combustion chamber.

Figure 5:
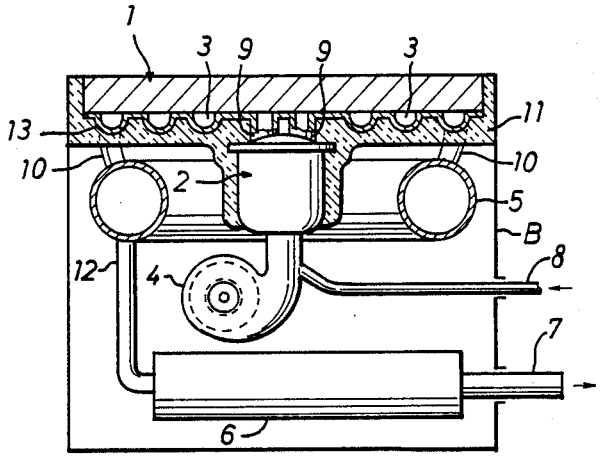
FIG. 5 is a vertical sectional view of a modification of the gas cooking appliance shown in FIG. 1.
Figure 6:
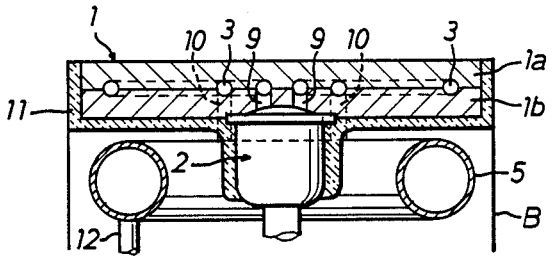
FIG. 6 is a vertical sectional view of another modification of the gas cooking appliance shown in FIG. 1.

In FIG. 5 there is illustrated a modification of the cooking appliance, wherein the tailpipe passages 3 are formed by a pressed sheet metal 13 which is preliminarily pressed to form a pair of grooves corresponding to the tailpipe passages 3 and welded to the bottom surface of iron plate 1. In this modification, the pressed sheet metal 13 is unitedly coupled at its center with the combustion chamber of burner 2 and covered with the heat insulating layer 11. The cooking appliance may be further modified as shown in FIG. 6, wherein the iron plate 1 is composed of two iron plate sections 1*a* and 1*b* which are each formed with a pair of grooves corresponding to the tailpipe passages 3 shown in FIGS. 1 and 2 and are unitedly secured to one another. In the modification of FIG. 6, the lower iron plate section 1*b* is unitedly coupled at its center with the combustion chamber of burner 2.

For operation of the gas cooking appliance, gaseous fuel and fresh air are supplied into the mixing chamber of burner 2 from the gas supply conduit 8 and blower 4. On start up, the mixture of gaseous fuel and air is ignited by a spark plug (not shown) to effect pulse combustion in the combustion chamber. Once started by the spark plug, the pulse combustion in the combustion chamber continues as long as gaseous fuel is supplied. The principles of pulse combustion are sufficiently well known so as to not require a general explanation herein. It is sufficient to understand that positive pressure pulses in the combustion chamber drive the combustion products successively through the tailpipe passages 3, exhaust decoupler 5 and muffler 6 to the exhaust pipe 7 which exhausts ultimately to the exterior. As the combustion products pass through the tailpipe passages 3, they act to efficiently heat the iron plate 1. In this instance, the entirety of iron plate 1 is uniformly heated by the combustion products due to the large heat capacity of itself, while the temperature of the combustion products is decreased due to heat absorption of the iron plate 1. Additionally, the tailpipe passages 3 cooperate with the exhaust decoupler 5 and muffler 6 to silence the combustion noises of the burner. Thus, the heat of the combustion products is efficiently utilized to ensure a high heating efficiency of the burner.

Although the preferred embodiments of the present invention have been shown and described, it should be understood that various modifications and rearrangements of the parts may be resorted to without departing from the scope of the invention as disclosed and claimed herein.

What is claimed is:

1. A gas cooking appliance for cooking chow mein, pan cakes or the like on a hot plate mounted thereon, comprising:

a pulse combustion burner, installed within an internal compartment of the appliance and having an combustion chamber coupled with a bottom portion of said hot plate suitable to effect pulse combustion of a mixture of gaseous fuel and air supplied thereinto;

wherein said hot plate is in the form of a thick metallic plate having therein a tailpipe passage which is connected at one end thereof to an exhaust port of said combustion chamber and extends outwardly through said metallic plate to permit the flow of combustion products, discharged therethrough, from said combustion chamber.

2. A gas cooking appliance as claimed in claim 1, wherein said combustion chamber of said burner is unitedly coupled with a center of the bottom portion of said metallic plate, and wherein said metallic plate has therein a plurality of tailpipe passages which are connected at one of their respective ends to the exhaust port of said combustion chamber and extend outwardly through said metallic plate to permit the flow of combustion products discharged therethrough from said combustion chamber.

3. A gas cooking appliance as claimed in claim 1, wherein said combustion chamber of said burner is integrally coupled with a center of the bottom portion of said metallic plate, and wherein said metallic plate has therein a pair of sinuous tailpipe passages which are connected at one of their respective ends to the exhaust port of said combustion chamber and extend respectively through a half part of said metallic plate outwardly to permit the flow of combustion products discharged therethrough from said combustion chamber.

4. A gas cooking appliance as claimed in claim 3, wherein each of said sinuous tailpipe passages is formed in said metallic plate to have an inside curved section extending from the exhaust port of said combustion chamber and an outside curved section extending outwardly from the inside curved section.

5. A gas cooking appliance as claimed in claim 3, wherein each of said sinuous tailpipe passages is formed in said metallic plate to have an inside waved section encircled by an outside curved section extending from the exhaust port of said combustion chamber.

6. A gas cooking appliance as claimed in claim 1, wherein said combustion chamber of said burner is unitedly coupled with a center of the bottom portion of said metallic plate, and wherein said metallic plate has therein a pair of spiral tailpipe passages which are connected at one of their respective ends to the exhaust port of said combustion chamber and extend in parallel outwardly through said metallic plate to permit the flow of combustion products discharged therethrough from said combustion chamber.

7. A gas cooking appliance as claimed in claim 1, wherein an annular exhaust decoupler is arranged in surrounding relationship with said combustion chamber and connected to the outlet end of said tailpipe passage.

* * * * *